US008006991B2

(12) United States Patent
Taniuchi et al.

(10) Patent No.: US 8,006,991 B2
(45) Date of Patent: Aug. 30, 2011

(54) CONSTRUCTION MACHINE

(75) Inventors: Tomoya Taniuchi, Hiroshima (JP); Koji Yonezawa, Hiroshima (JP)

(73) Assignee: Kobelco Construction Machinery Co., Ltd., Hiroshima-shi (JP)

( * ) Notice: Subject to any disclaimer, the term of this patent is extended or adjusted under 35 U.S.C. 154(b) by 626 days.

(21) Appl. No.: 11/830,500

(22) Filed: Jul. 30, 2007

(65) Prior Publication Data

US 2008/0034621 A1 Feb. 14, 2008

(30) Foreign Application Priority Data

Aug. 11, 2006 (JP) ..... 2006-219670

(51) Int. Cl.
*B60R 3/00* (2006.01)
*B60K 11/06* (2006.01)

(52) U.S. Cl. ..... 280/164.1; 180/68.1

(58) Field of Classification Search ..... 280/163, 280/164.1, 169; 180/68.1, 68.2, 68.3
See application file for complete search history.

(56) References Cited

U.S. PATENT DOCUMENTS

| | | | | |
|---|---|---|---|---|
| 2,501,819 | A * | 3/1950 | Kloepper | 180/309 |
| 4,133,547 | A * | 1/1979 | Fox | 180/68.3 |
| 4,825,975 | A * | 5/1989 | Symes | 182/92 |
| 6,810,979 | B2 * | 11/2004 | Johansson et al. | 180/69.21 |
| 2004/0173395 | A1 * | 9/2004 | Arai et al. | 180/68.1 |
| 2005/0188926 | A1 * | 9/2005 | Kimura et al. | 123/41.7 |
| 2009/0033058 | A1 * | 2/2009 | VanderGriend et al. | 280/164.1 |

FOREIGN PATENT DOCUMENTS

| | | |
|---|---|---|
| JP | 6-24360 | 2/1994 |
| JP | 11-200415 | 7/1999 |
| JP | 2000-45332 | 2/2000 |
| JP | 2002-61222 | 2/2002 |
| JP | 2005-248505 | 9/2005 |

OTHER PUBLICATIONS

Office Action issued Jul. 30, 2010, in Chinese Patent Application No. 200710141004.1, filed Aug. 13, 2007 (with English-language Translation).

* cited by examiner

*Primary Examiner* — Frank B Vanaman
(74) *Attorney, Agent, or Firm* — Oblon, Spivak, McClelland, Maier & Neustadt, L.L.P.

(57) ABSTRACT

In a hydraulic excavator, in a rear part of an upper rotating body mounted on a lower traveling body is disposed an engine room, and in a front surface of a partition wall for partitioning the front surface side of the engine room from the exterior is provided a step serving as a foothold for opening and closing a bonnet and performing maintenance work. On the lower side of the step, a duct for exhausting the air within the engine room to the exterior is formed in a state that the step serves as an upper surface wall of the duct.

12 Claims, 9 Drawing Sheets

CONSTRUCTION MACHINE

BACKGROUND OF THE INVENTION

1. Field of the Invention

The present invention relates to a construction machine such as a hydraulic excavator in which an exhaust structure from an engine room is improved.

2. Description of the Related Art

FIGS. 8 and 9 show a hydraulic excavator to which the present invention is applied.

The reference numeral 1 denotes a crawler type lower traveling body. On the lower traveling body 1, is mounted an upper rotating body 2 rotatably around a vertical axis. In an upper frame 3 of the upper rotating body 2, are installed a working attachment 10 including a boom 4, an arm 5, a bucket 6, a boom cylinder 7, an arm cylinder 8, a bucket cylinder 9 (hydraulic cylinders) for operating the boom, the arm and the bucket, a cabin 11 and the like.

On a rear part of the upper frame 3, is disposed an engine room 12 whose periphery is covered by a guard member (reference numeral thereof omitted). In the engine room 12, are installed an engine 13, devices around the engine 13 (a radiator 14, a cooling fan 15, a hydraulic pump 16 and the like). In FIGS. 8 and 9, the reference numeral 17 denotes a counterweight which also serves as the guard member on the back surface side.

In an upper surface part of the engine room 12, is disposed a bonnet 18 openably taking the rear side as a support point on a central part in the lateral direction. By opening the bonnet 18, maintenance of the engine 13 and the like is performed from the upper surface side of the engine room.

Meanwhile, as an access passage for the maintenance from the upper surface side of the engine, up and down steps 19 for going up are provided on the right side of the upper rotating body 2 (on the right side seen from an operator seated in the cabin 11, the lateral direction described hereinafter will be the same), and a step (shown by a diagonal line) 20 as a foothold for maintenance work is provided on the left side of a top of the steps 19 and just on the front side of the engine room 12. Therefore, a worker is able to go up the up and down steps 19 onto the step 20 from the front side of the machine as shown by double line arrows in FIG. 9, for opening and closing the bonnet 18 and performing the maintenance work.

On a peripheral wall of the engine room 12, are provided an intake port and an exhaust port (not shown). By rotation of the cooling fan 15, as shown by dashed line arrows in FIG. 9, the outside air is taken into the engine room 12 and exhausted to the exterior after a heat exchange operation.

In the above-mentioned construction, a point that the step 20 for the maintenance work is provided just on the front side of the engine room 12 is disclosed in Japanese Patent Laid-Open No. Hei11-200415.

Further, in a small excavator, a technique that in order to improve an exhaust and cooling efficiency, a duct (auxiliary opening) opening toward the outside of the engine room is provided in an outer periphery of the cooling fan is disclosed in Japanese Patent Laid-Open No. 2005-248505.

Particularly in the small type excavator, a surface area of the peripheral wall of the engine room is so small that size of the exhaust port is limited. Therefore, there is a problem that the exhaust and cooling efficiency is basically not sufficient. With regard to this point, as shown in Japanese Patent Laid-Open No. 2005-248505, addition of a duct for exhaust in the vicinity of the engine room is an effective countermeasure.

However, in the small type excavator originally having no extra space, a space for the addition of the duct is limited and only a small duct can be provided. Therefore, it is not possible to improve the exhaust and cooling efficiency as expected.

Further, built-in of the duct itself is troublesome so that an assembling performance of the machine is worsened, and addition of an exclusive duct increases the number of parts. As a result of the above-mentioned facts, there is also a problem that cost is increased.

SUMMARY OF THE INVENTION

It is an object of the present invention to provide a construction machine in which a duct having sufficient size can be reasonably formed within a limited space with the minimum number of parts and low cost.

Firstly, the construction machine according to the present invention has the following basic construction.

That is, the construction machine according to the present invention comprises an upper rotating body rotatably mounted on a lower traveling body, a bonnet for opening and closing the upper surface side portion of an engine room housing an engine, the bonnet being disposed on a rear part of the upper rotating body, a step serving as a foothold for opening and closing work of the bonnet and for maintenance work, the step being provided in an upper frame of the upper rotating body on the front side of the engine room, and a duct for exhausting the air within the engine room into the exterior, the duct being provided on the lower side of the step. Further, the duct is provided in a state that the step forms an upper surface wall of the duct.

The step for maintenance has sufficiently large width and depth sizes for a role thereof of the foothold for work, and is located just on the front side of the engine room as disclosed in Japanese Patent Laid-Open No. Hei11-200415.

The present invention focuses on these two points and provides the duct for improving an exhaust and cooling efficiency in a state that the step also serves as the upper surface wall of the duct. Therefore, it is possible to reasonably form the duct having sufficient size with the minimum number of parts and low cost without taking an extra from the limited space.

DESCRIPTION OF THE PREFERRED EMBODIMENTS

Embodiments of the present invention will be described with reference to FIGS. 1 to 7.

The embodiments are exemplified in a case where the present invention is applied to a hydraulic excavator.

Figure 1:
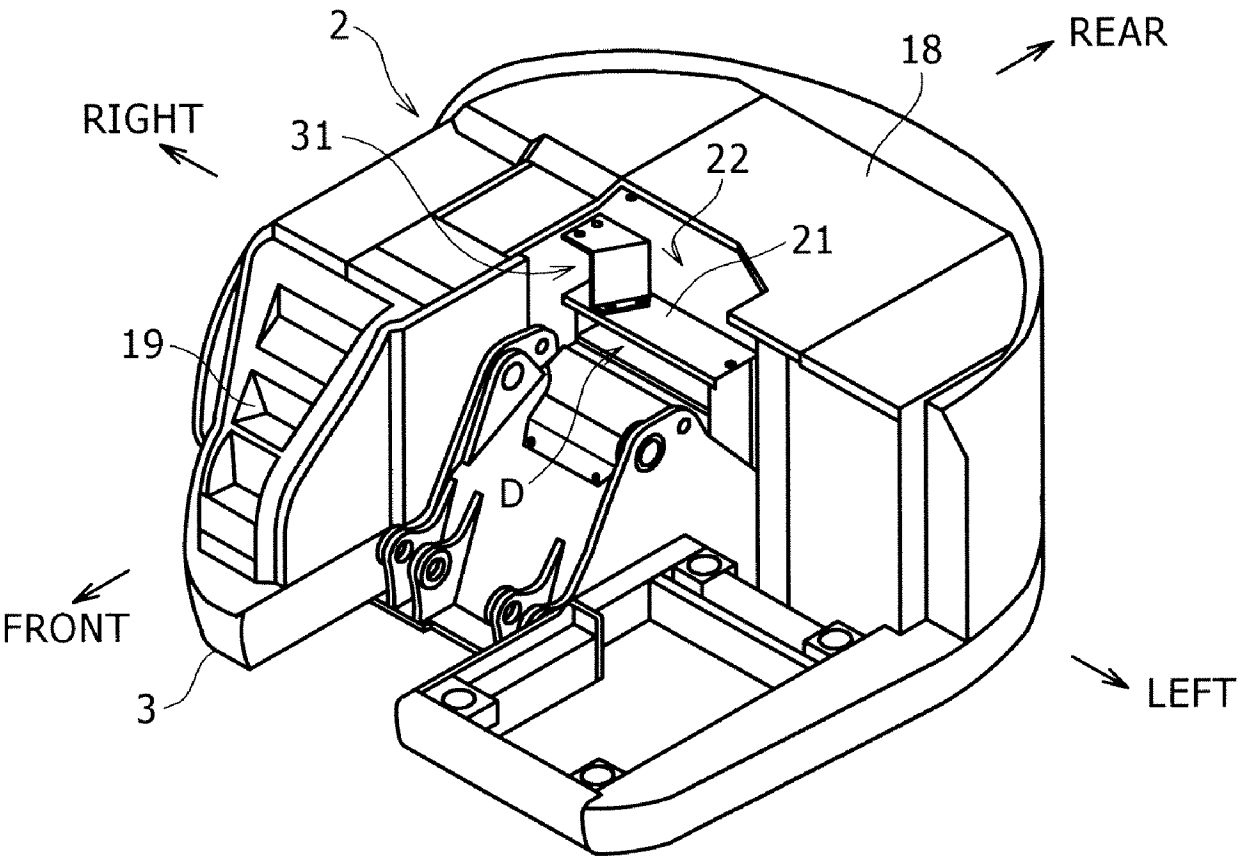
FIG. 1 is a perspective view of an upper rotating body of a hydraulic excavator according to an embodiment of the present invention.
Figure 2:
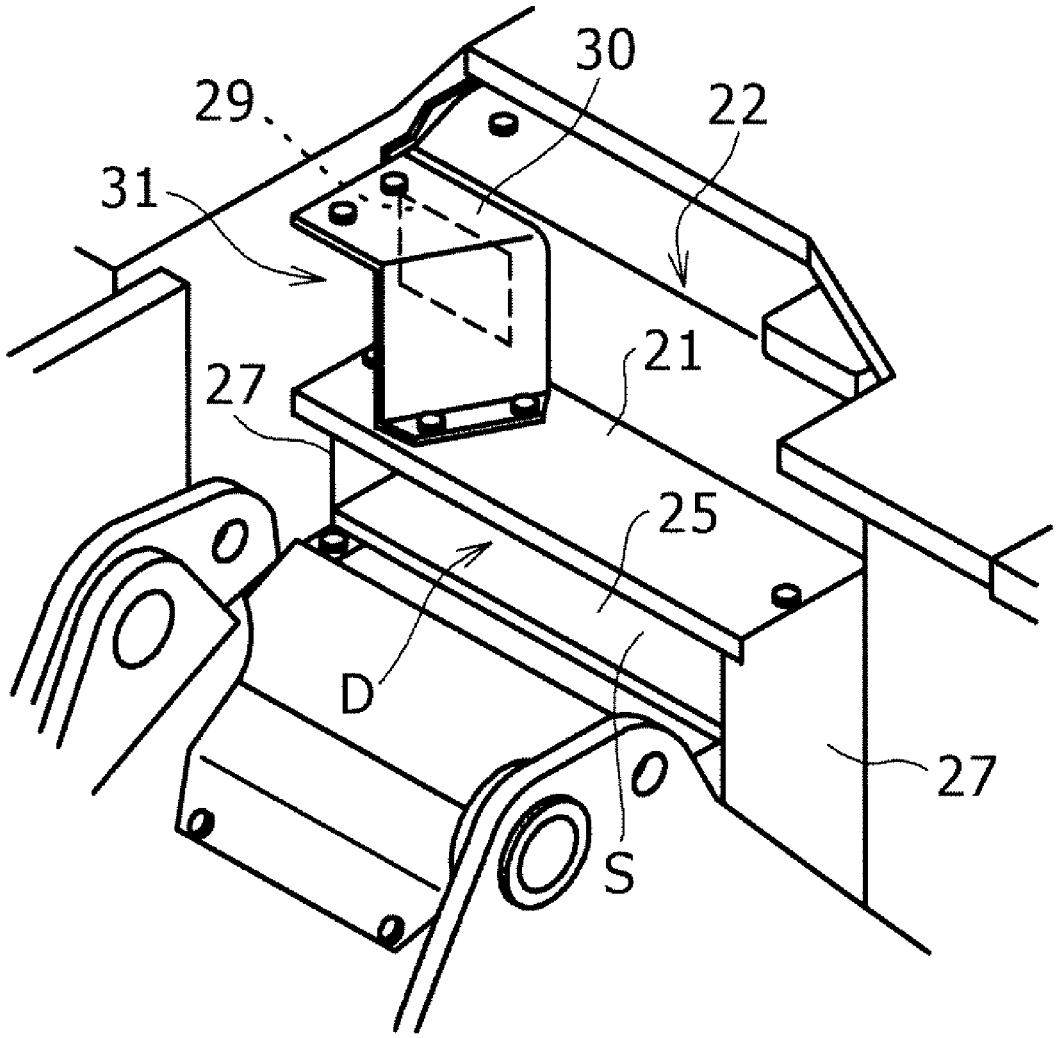
FIG. 2 is a partially enlarged view of FIG. 1.
Figure 3:
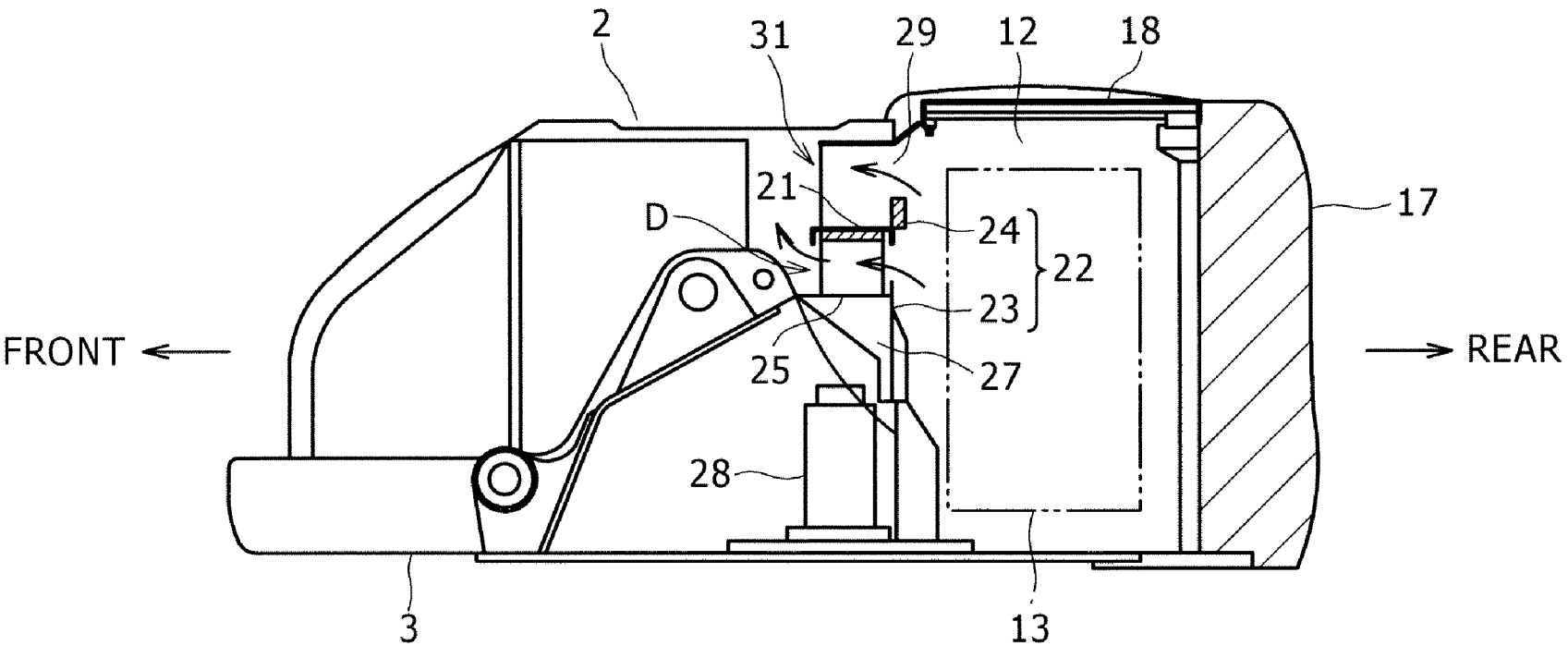
FIG. 3 is a side sectional view of the upper rotating body.

FIGS. 1 and 3 show an entire construction of an upper rotating body 2 in the hydraulic excavator (a cabin and a working attachment are omitted from the figures).

Figure 4:
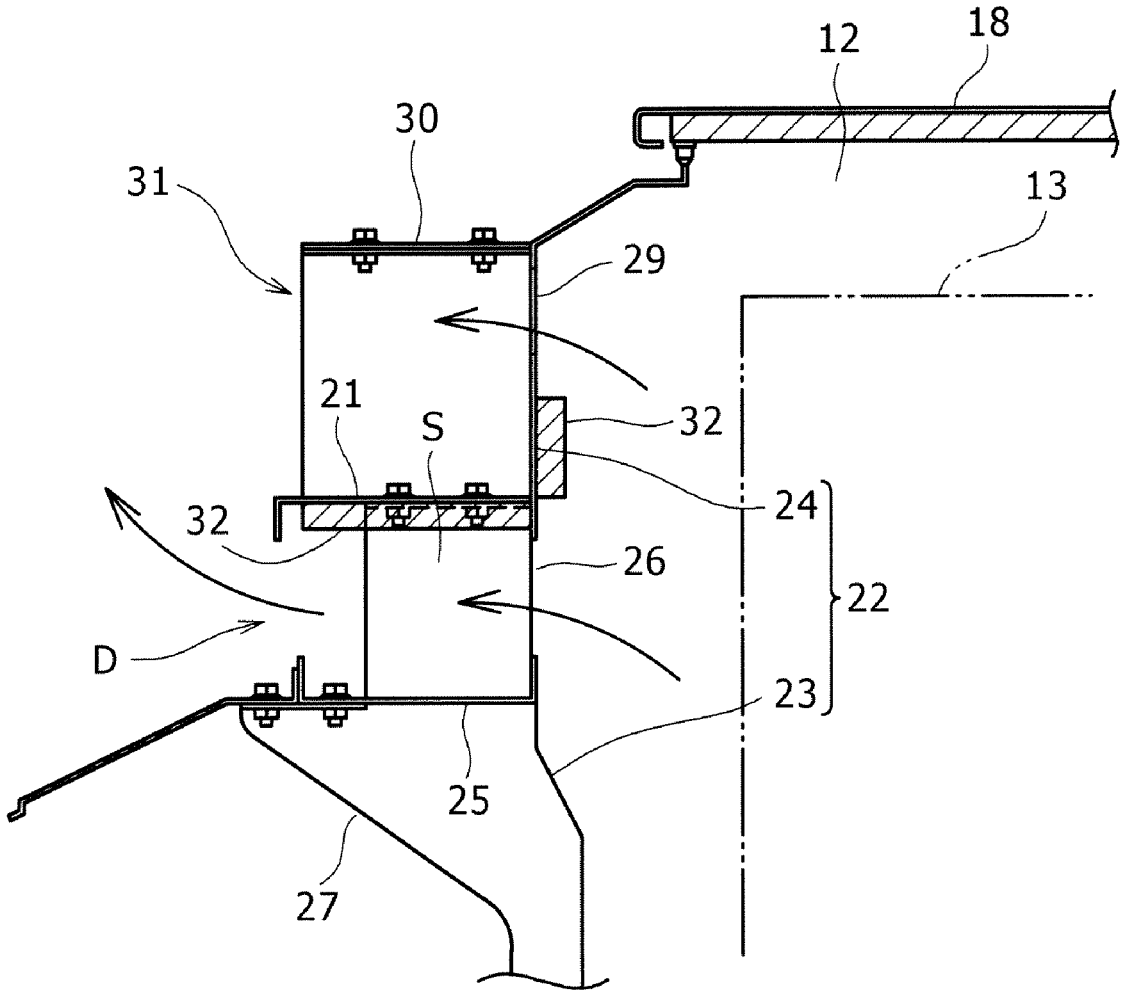
FIG. 4 is a partially enlarged view of FIG. 3.
Figure 8:
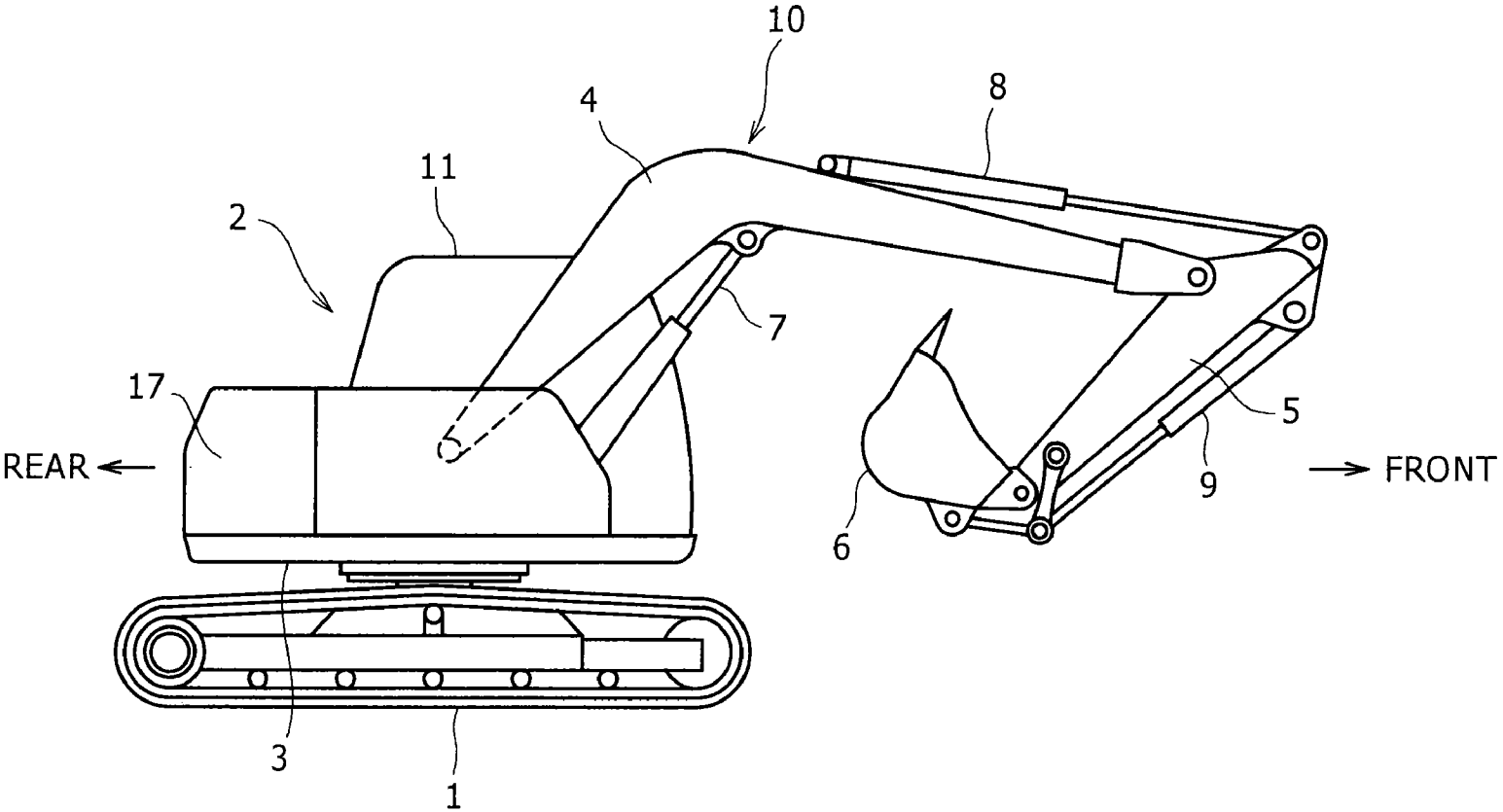
FIG. 8 PRIOR ART
FIG. 8 is an entire side view of the hydraulic excavator.
Figure 9:
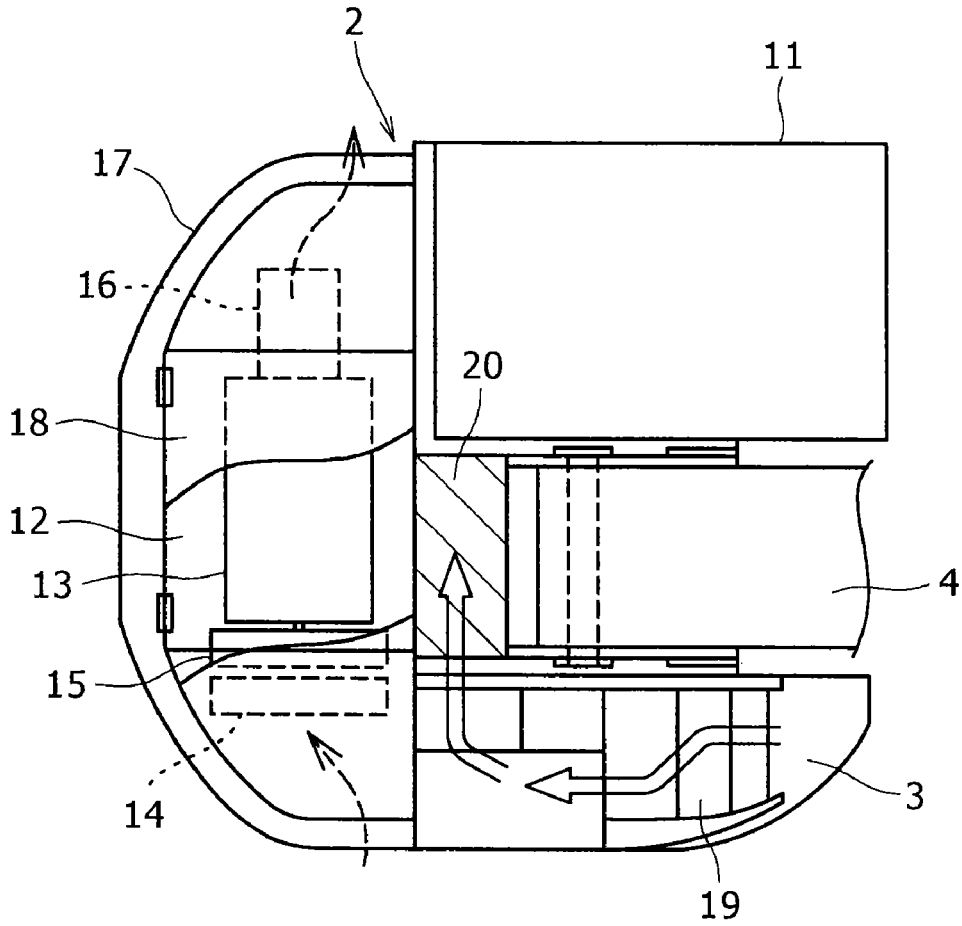
FIG. 9 PRIOR ART
FIG. 9 is a plan view of the hydraulic excavator.

A basic construction of the upper rotating body 2 i.e., the following points are the same as THE RELATED ART shown in FIGS. 8 and 9:

(A) a point that on a rear part of an upper frame 3, is formed an engine room 12 whose periphery is covered by a guard member including a counterweight 17 (refer to FIGS. 3 and 4);

(B) a point that in the engine room 12, are installed an engine 13 and related devices;

(C) a point that a bonnet 18 for opening and closing the upper surface side portion of the engine room 12 is provided;

(D) a point that as an access passage for opening the bonnet 18 and performing maintenance of the engine and the like from the upper surface side of the engine room, up and down steps 19 are provided in a front part on the right side.

In each of the figures, the same parts as THE RELATED ART are represented by the same numerals.

Further, in the present embodiment, as well as THE RELATED ART, a step 21 serving as a foothold in which a worker going up the up and down steps 19 can open and close the bonnet 18 and perform the maintenance work on the front side of the engine room 12 is provided on the upper frame 3. Below the step 21, is formed a duct D for exhausting the air within the engine room 12 to the exterior.

This point will be described in detail with reference to each of the figures.

A partition wall 22 for partitioning the front surface side of the engine room 12 from the exterior is provided on the upper frame 3.

The partition wall 22 is divided into separate two members, i.e. a lower partition plate 23 for partitioning a lower part of the front surface of the engine room; and an upper partition plate 24 for partitioning an upper part. In the lower partition plate 23, is forwardly projected a duct lower surface plate 25, and in the upper partition plate 24 is forwardly projected the step 21 respectively.

Both the partition plates 23 and 24 are attached on the upper frame in a state that the step 21 and the duct lower surface plate 25 are vertically opposed to each other and an exhaust port 26 and a duct space S which communicate with the engine room 12 are formed between the step 21 and the duct lower surface plate 25.

As a part of partition attachment means, on the upper frame, are aligned a pair of left and right attachment plates 27 with a gap. Both left and right ends of the step 21 and the duct lower surface plate 25 are attached to and supported by the attachment plates 27.

Figure 7:
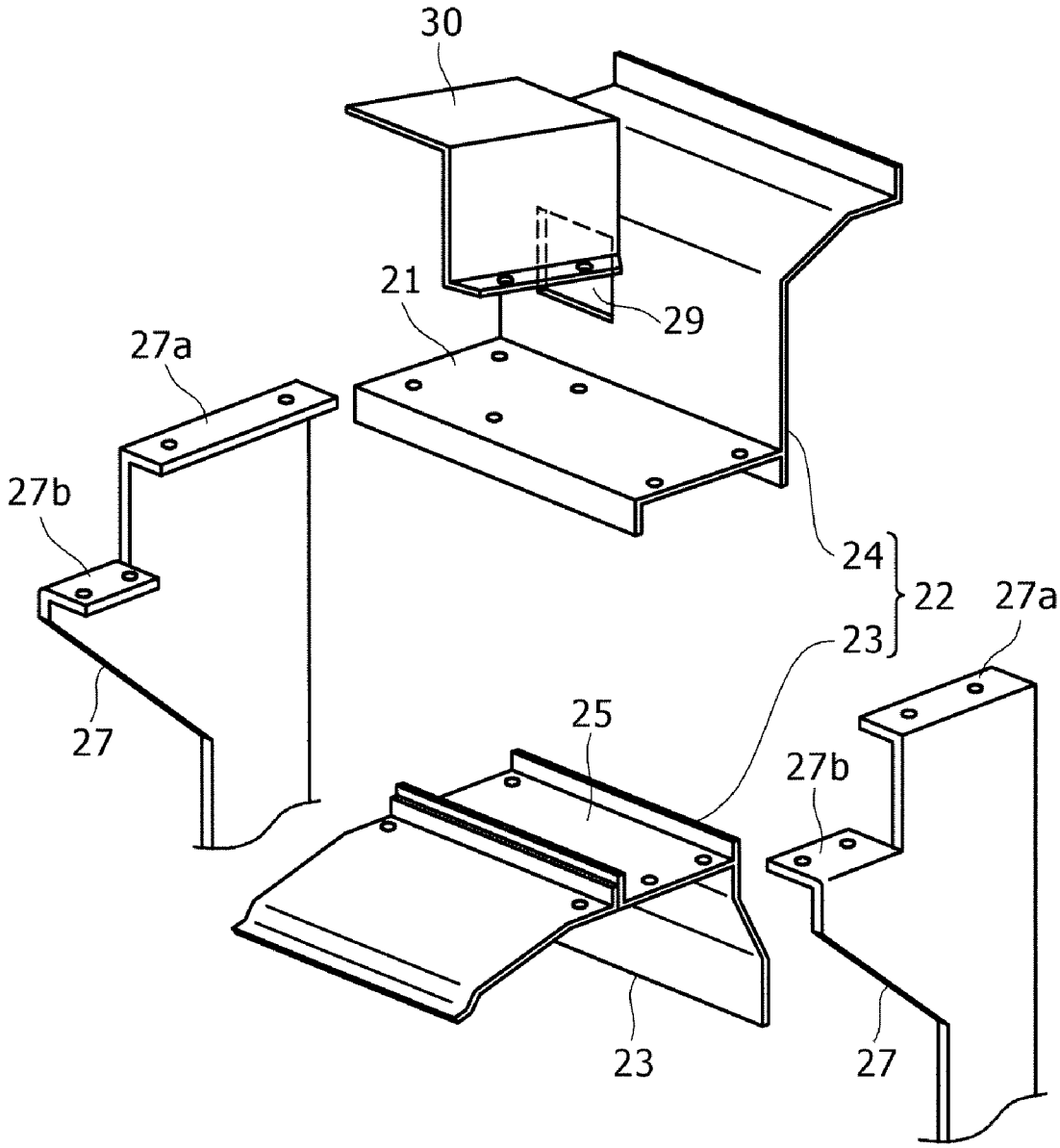
FIG. 7 is an exploded perspective view of members forming a duct.

In FIG. 7, the reference numeral 27*a* denotes step attachment portions of the attachment plates 27, and the reference numeral 27*b* denotes duct lower surface plate attachment portions.

In this way, the partition wall 22 is formed by both the partition plates 23 and 24. On the lower side of the step 21, are formed the exhaust port 26 for exhausting the air within the engine room 12 to the exterior, and the duct D for performing a sound absorbing operation while guiding the exhausted air forwardly in a state that the step 21 is an upper surface wall thereof, the duct lower surface plate 25 is a lower surface wall thereof, and the attachment plates 27 are left and right side walls.

Figure 5:
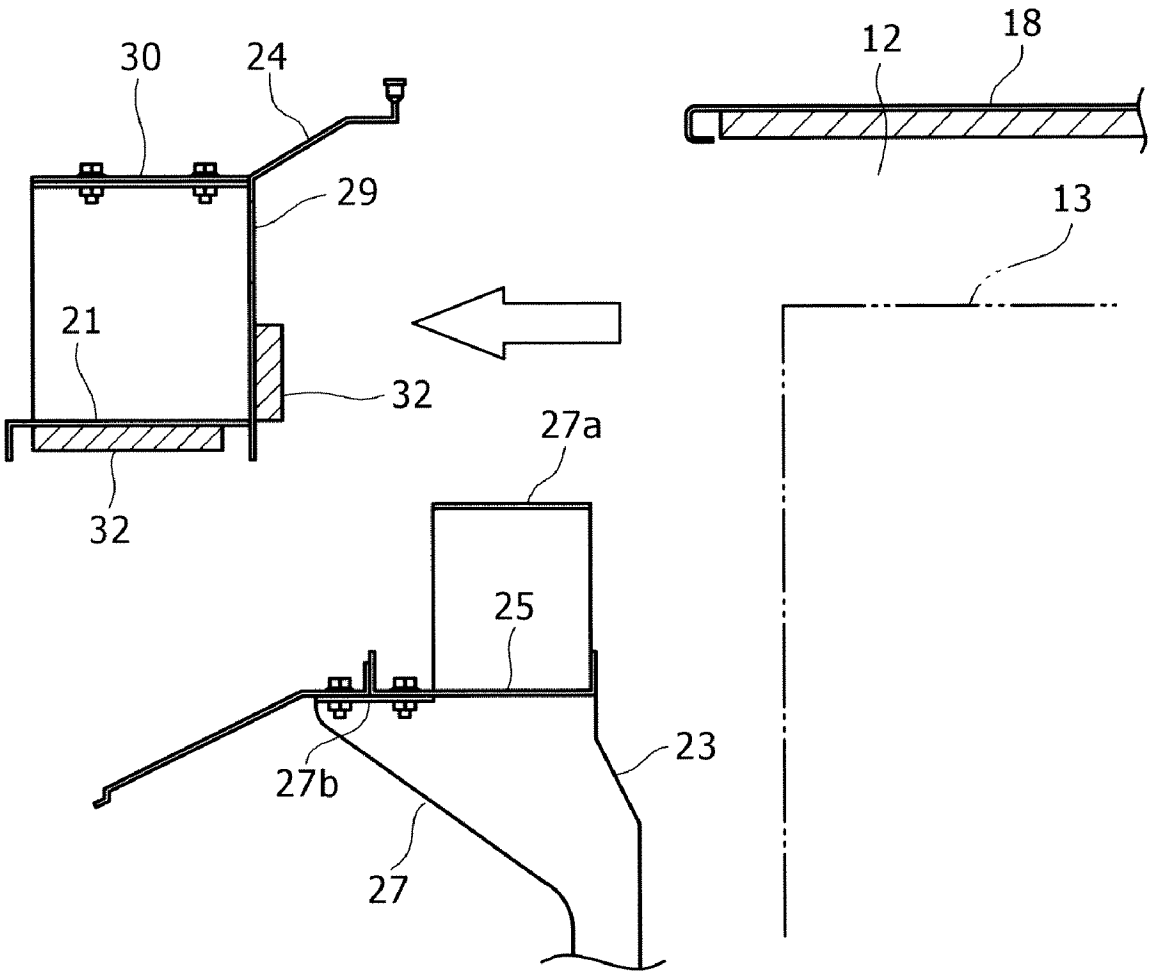
FIG. 5 is a view corresponding to FIG. 4 in a state that an upper partition plate is removed.
Figure 6:
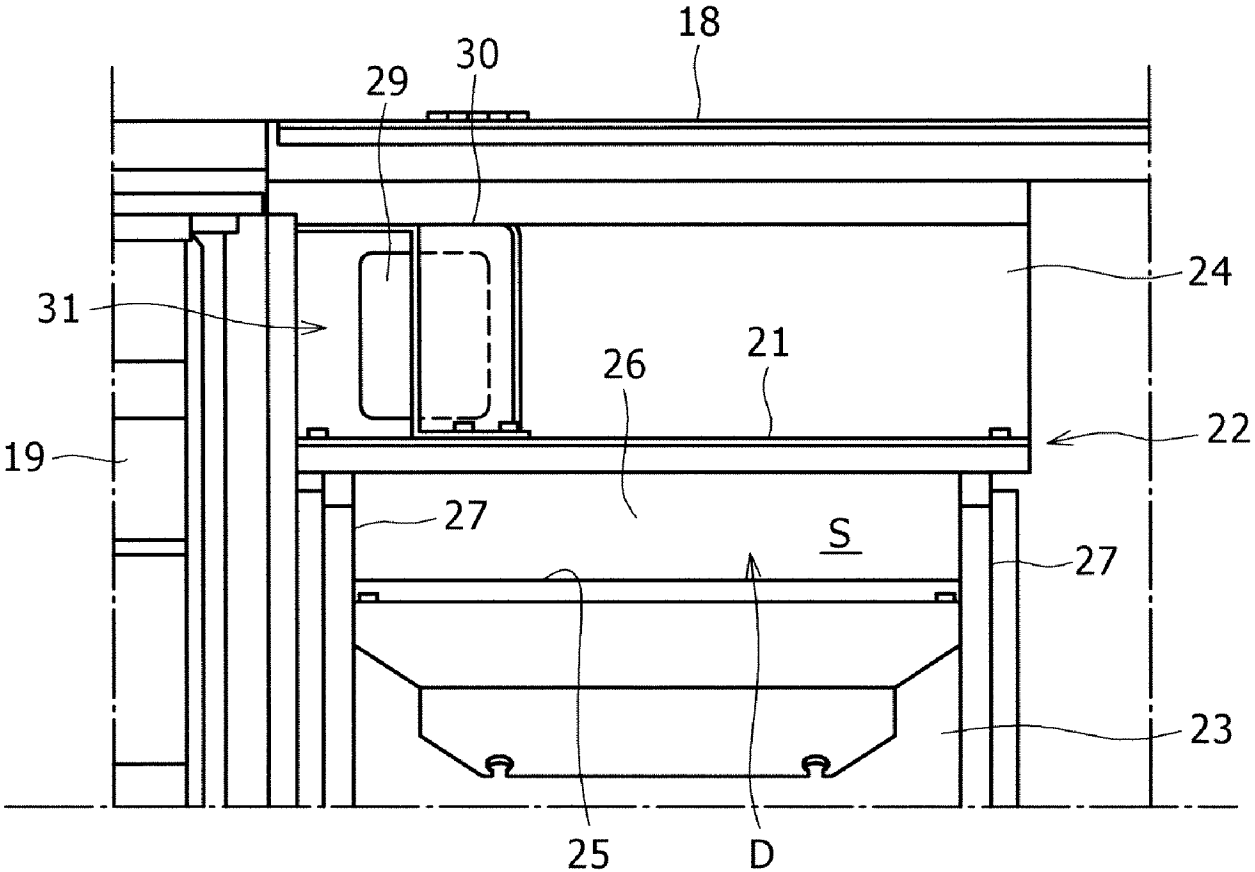
FIG. 6 is a partially enlarged front view of the upper rotating body.

The upper partition plate 24 is detachably attached at all attachment parts including attachment parts of the step 21 corresponding to the step attachment portions 27*a* of the attachment plates 27 by attachment means such as a bolt and a nut. As a result, as shown in FIG. 5, the upper partition plate is formed so as to be removed as necessary.

The duct lower surface plate 25 of the lower partition plate 23 also serves as a rotation motor cover for covering a rotation hydraulic motor 28 (refer to FIG. 3) disposed on the upper frame 3 from the upper side, in a state that the partition plate is attached.

According to this construction, the duct D for improving the exhaust and cooling efficiency from the engine room 12 is provided below the step 21 serving as a foothold of the maintenance work, in a state that the step 21 also serves as the upper surface wall of the duct. By this, even in the small type excavator, it is possible to reasonably form the duct with the minimum number of parts and low cost without taking an extra for the duct from the limited space.

In this case, the step 21 originally has width and depth sizes which are sufficient for a worker to get on and safely work. By utilizing the step 21 as the upper surface wall of the duct, it is possible to form the duct D having a sufficient size for performing the exhaust and cooling operation.

Further, the partition wall 22 is divided into the lower partition plate 23 and the upper partition plate 24, the step 21 and the duct lower surface plate 25 which are duct elements are attached to the plates respectively, and both the partition plates 23 and 24 are separately attached to the upper frame 3 in a state that the duct space S is formed between the plates. Therefore, since there is no need for directly connecting both the partition plates 23 and 24 to each other, an assembling performance of the partition wall 22 and the duct D is improved.

In addition, the upper partition plate 24 provided with the step 21 is detachably mounted to the upper frame 3. Therefore, as shown in FIG. 5, by removing the upper partition plate 24, it is possible to open and utilize the front surface side of the engine room 12 as a maintenance hole. By this, it is possible to enlarge the maintenance hole so that the maintenance work becomes convenient.

Meanwhile, since the duct lower surface plate 25 also serves as the rotation motor cover, a use of one type of part for several purposes is facilitated. Therefore, the number of parts is reduced and the assembling performance and the cost become further favorable.

In the present embodiment, as another construction, in a right side end of the upper partition plate 24 are openably formed an auxiliary exhaust port 29 (refer to FIGS. 4, 6 and 7), in a right side end of an upper surface of the step 21 is attached an auxiliary step 30 in an inverted L shape, and an auxiliary duct 31 communicating with the engine room 12 through the auxiliary exhaust port 29 is formed by the auxiliary step 30, the step 21 and the attachment plate 27 on the right.

By providing the auxiliary duct 31, it is possible to further improve the exhaust and cooling efficiency of the engine room 12 and a sound absorbing effect. Further, by providing the auxiliary step 30 at a location which is one step higher than the step 21, the foothold is improved and the maintenance work becomes convenient.

In order to improve the sound absorbing effect in the duct D or the like, a sound absorbing material 32 is provided as shown in FIGS. 4 and 5. In the figures, a case where the sound absorbing material 32 is provided only on a lower surface of the step 21 and on the inner side of the auxiliary exhaust port 29 is exemplified. However, the sound absorbing material may be provided in a wider range such as parts of the attachment plates 27 which also serve as the left and right side walls of the duct D, and an inner surface of the auxiliary step 30.

Other Embodiments (1) In the above embodiment, the partition wall 22 is divided into the lower partition plate 23 and the upper partition plate 24. However, the partition wall 22 may be formed vertically continuously. In this case, the exhaust port 26 is openably formed in the partition wall 22, and the step 21 and the duct lower surface plate (rotation motor cover) 25 are attached to a front surface thereof.

(2) In the above embodiment, the air within the engine room 12 is guided from the exhaust port 26 to the duct D. However, an air guiding tube may be connected to an exhaust port provided in a different location from the duct D, and a front end thereof may be coupled to the duct D.

(3) The present invention is not limited to the hydraulic excavator, but widely applied to a construction machine in which an engine room and a bonnet for opening an closing the engine room are disposed on a rear part of an upper rotating body, and a step for opening and closing the bonnet and performing maintenance is provided.

Although the invention has been described with reference to the preferred embodiments in the attached figures, it is noted that equivalents may be employed and substitutions made herein without departing from the scope of the invention as recited in the claims.

We claim:

1. A construction machine, comprising:

a lower traveling body;

an upper rotating body rotatably mounted on said lower traveling body;

a bonnet for opening and closing an upper surface side portion of an engine room housing an engine, the bonnet being disposed on a rear part of said upper rotating body;

a step comprising a horizontal surface located below a top surface of said bonnet, said step serving as a foothold for opening and closing work of said bonnet and for maintenance work, the step being provided in an upper frame of said upper rotating body on a front side of said engine room;

a duct for exhausting the air within said engine room to the exterior, the duct being provided on the lower side of said step, which step is located exteriorly of the bonnet when the bonnet has closed the upper surface side portion of the engine room, the duct being provided in a state that said step forms an upper surface wall of said duct; and a partition wall that partitions the front surface side of said engine room from the exterior, said step being attached to a front surface of said partition wall, whereby the step extends forwardly from the partition wall and exteriorly of the engine room.

2. The construction machine according to claim 1, wherein the partition wall for partitioning the front surface side of said engine room from the exterior is divided into an upper partition plate and a lower partition plate, a duct lower surface plate is attached to a front surface of said lower partition plate, and both said upper partition plate and said lower partition plates are separately attached to said upper frame of said upper rotating body in a state that an exhaust port and a duct space communicating with said engine room are formed between said step and said duct lower surface plate.

3. The construction machine according to claim 2, wherein said upper partition plate provided with said step is mounted detachably to said upper frame.

4. The construction machine according to claim 2, wherein said lower partition plate is attached in a state that said duct lower surface plate also serves as a rotation motor cover for covering a rotation hydraulic motor for rotating and driving said upper rotating body from the upper side.

5. The construction machine according to claim 1, wherein a sound absorbing material is provided on an inner surface of said duct including a lower surface of said step.

6. A construction machine, comprising:

a lower traveling body;

an upper rotating body rotatably mounted on said lower traveling body;

a bonnet for opening and closing an upper surface side portion of an engine room housing an engine, the bonnet being disposed on a rear part of said upper rotating body;

a step serving as a foothold for opening and closing work of said bonnet and for maintenance work, the step being provided in an upper frame of said upper rotating body on a front side of said engine room;

a duct for exhausting the air within said engine room to the exterior, the duct being provided on the lower side of said step, which step is located exteriorly of the bonnet when the bonnet has closed the upper surface side portion of the engine room, the duct being provided in a state that said step forms an upper surface wall of said duct, wherein an auxiliary step is attached to a part of an upper surface of said step and an auxiliary duct is formed by said step and said auxiliary step as constituent elements; and a partition wall that partitions the front surface side of said engine room from the exterior, said step being attached to a front surface of said partition wall, whereby the step extends forwardly from the partition wall and exteriorly of the engine room.

7. A construction machine, comprising:

a lower traveling body;

an upper rotating body rotatably mounted on said lower traveling body;

a bonnet for opening and closing an upper surface side portion of an engine room housing an engine, the bonnet being disposed on a rear part of said upper rotating body;

a step comprising a horizontal surface located below a top surface of said bonnet, said step serving as a foothold for opening and closing work of said bonnet and for maintenance work, the step being provided in an upper frame of said upper rotating body on a front side of said engine room;

a partition wall for partitioning a front surface side of the engine room from the exterior, being provided on the upper frame, said step being attached to a front surface of said partition wall, whereby the step extends forwardly from the partition wall and exteriorly of the engine room; and a duct for exhausting the air within said engine room to the exterior, the duct being provided on the lower side of said step, the duct being provided in a state that said step also serves an upper surface wall of said duct, and that an exhaust port by which a duct space communicates with the engine room is formed at the partition wall.

8. The construction machine according to claim 7, wherein the partition wall is divided into an upper partition plate and a lower partition plate, a duct lower surface plate is attached to a front surface of said lower partition plate, and both said upper partition plate and said lower partition plates are separately attached to said upper frame of said upper rotating body in a state that the exhaust port and the duct space are formed between said step and said duct lower surface plate.

9. The construction machine according to claim 8, wherein said upper partition plate provided with said step is mounted detachably to said upper frame.

10. The construction machine according to claim 8, wherein said lower partition plate is attached in a state that said duct lower surface plate also serves as a rotation motor cover for covering a rotation hydraulic motor for rotating and driving said upper rotating body from the upper side.

11. The construction machine according to claim 7, wherein an auxiliary step is attached to a part of an upper surface of said step and an auxiliary duct is formed by said step and said auxiliary step as constituent elements.

12. The construction machine according to claim 7, wherein a sound absorbing material is provided on an inner surface of said duct including a lower surface of said step.

* * * * *